United States Patent [19]

Chang

[11] 4,067,578

[45] Jan. 10, 1978

[54] CHESS BOARD AND PIECES

[76] Inventor: Chiu-Hua Chang, No. 50, Hsin I Road, Lu Chou, Taipei Hsien, China /Taiwan

[21] Appl. No.: 717,574

[22] Filed: Aug. 26, 1976

[51] Int. Cl.[2] ..... A63F 3/02

[52] U.S. Cl. ..... 273/261; 273/291

[58] Field of Search ..... 273/131, 137

[56] References Cited

U.S. PATENT DOCUMENTS

| | | | |
|---|---|---|---|
| D. 129,154 | 8/1941 | Weller | 273/131 KP UX |
| 511,306 | 12/1893 | Moore | 273/131 KP UX |
| 1,134,922 | 4/1915 | Smith | 273/131 KP |
| 2,722,424 | 11/1955 | Hum | 273/137 R X |

FOREIGN PATENT DOCUMENTS

| | | | |
|---|---|---|---|
| 501,371 | 1/1920 | France | 273/131 K |

*Primary Examiner*—Delbert B. Lowe

*Attorney, Agent, or Firm*—Burns, Doane, Swecker & Mathis

[57] ABSTRACT

Chess board and pieces provided for playing by four persons, comprise a chess board having a "central field" of 8 × 8 squares. Sixteen diagonally disposed squares in the central field are called "combat bases," and extending from each side of the central field is an 8 × 4 squares "domain" for each player. Four sets of chess pieces each having 16 men are provided as in the conventional set and positioned respectively in two rows in the domain of each player just like those in the conventional set. Each chess piece is of a cube form having six faces, with four out of the six faces painted with different colors representing each player's "country" and marked with the symbol of a man. Each player positions his pieces and turns up the face having his own color.

2 Claims, 3 Drawing Figures

CHESS BOARD AND PIECES

FIELD OF INVENTION

The present invention relates generally to a chess board and pieces, and more particularly to a novel chess board and pieces that can be played by four persons.

BACKGROUND OF INVENTION

In conventional chess playing, since only two persons are allowed to play, it seems that the game is dull, and the use of wits is somewhat limited. The present inventor has tried and successfully designed a novel chess board and pieces to enable the game to be played by more than two persons (up to four persons), providing more fun through the use of new strategy, such as uniting any two players against the other two, or even three against one, for example.

SUMMARY OF INVENTION

Therefore, the main object of the present invention is to provide a novel design of chess board and pieces that can be played by more than two (up to four) persons, with a chess board having an 8 × 8 square "central field". Extending from the four sides of the central field are four "domains" each having an 8 × 4 square area. Each player is provided with 16 pieces representing 16 men as in the conventional chess game.

Another object of the present invention is to provide a novel chess board as abovesaid having sixteen diagonally disposed squares called "combat bases," and rules in addition to the conventional rules of playing.

Still another object of the present invention is to provide chess pieces of cube form, each having four out of the six faces painted with a different color to represent the "country" of each player and marked with the symbol of a man. The initial positioning of the pieces of each player is conventional, yet with the face representing his own country color up.

A further object of the present invention is to provide new rules of playing so that under certain circumstances the captured power piece of the opponent's side is converted to the attacker's color to strengthen the attacker's force by simply turning up the face of the captured cube.

Still a further object of the present invention is to provide new strategy for playing by uniting any two countries against the other two, or even three against one.

Other objects and features of the present invention will become apparent from the following detailed description to be taken in conjunction with the annexed drawings.

BRIEF DESCRIPTION OF DRAWIGS

DETAILED DESCRIPTION OF EMBODIMENTS

Figure 1:
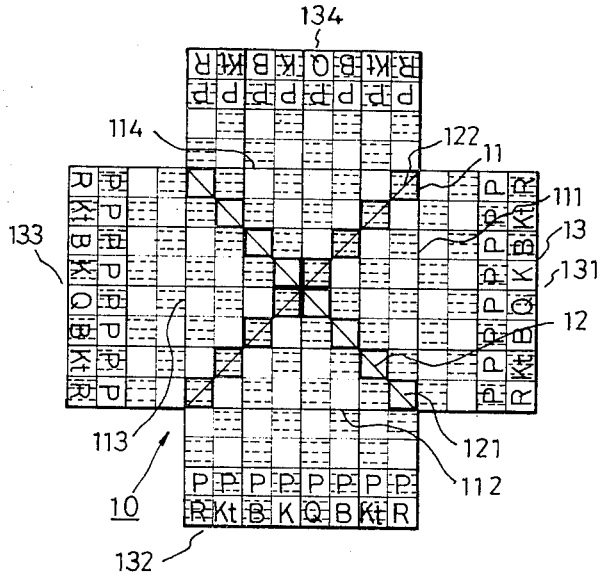
FIG. 1 depicts a plan view of an embodiment of the chess board of the present invention showing the initial position of the pieces.

Now referring to FIG. 1, the chess board 10 comprises "central field" 11 having sides 111, 112, 113, 114, each being 8 squares in dimension. Thus, the area of the central field is 8 × 8 squares in dimension. Within the central field are 16 squares (with heavy boundary line) disposed on the diagonal lines 121, 122 and desingated as "combat bases" 12. Extending from the four sides 111, 112, 113 and 114 of the central field 11 are four "domains" 131, 132, 133 and 134 (generally numbered as 13) representing four countries played by four persons. The squares on the chess board are colored alternately light and dark.

Each player receives a set of pieces representing 16 men consisting of a king(K), a queen (Q), two bishops (B), two knights (Kt), two rooks (R), and eight pawns (P). The initial position of the pieces on the board is shown in FIG. 1 just like in the conventional chess game.

Figure 2:
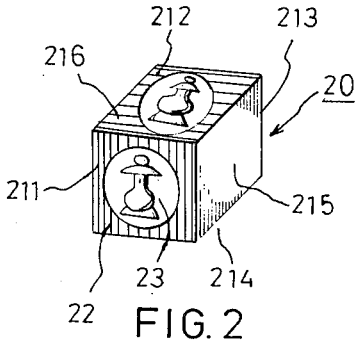
FIG. 2 is a perspective view of a cube-shape chess piece.

FIG. 2 shows a piece representing a certain man such as a pawn. The piece 20 is of a cube shape having six faces 211, 212, 213, 214, 215 and 216. Faces 211–214 each include a portion 23 deisgnating the type of man it is and a portion 22 painted with a different color representing the respective country of a player. In FIG. 2, for example, the portion 23, on each of the said four painted faces, is the symbol of a pawn. The Portions 22 of faces 211–214 are, for example, red, blue, green, and purple, respectively remaining two faces 215, 216 may be left blank.

In playing, each player positions his set of pieces with the face painted with the color of his own country turned up, and then players start playing in turn. Under certain circumstances, according to the new rules, when one attacks and captures an opponent's power piece, the captured cube is turned and converted to the attacker's color, instead of being moved off of the board, to strengthen the attacker's forces. Of course, the king is never captured but resigns when checkmated. At that time, the game of that country is over. The rules for playing shall be detailed later.

The conventional rules can generally be complied with without conflicting with the new rules of the new game provided for four players, (and furthermore the new rules are set to be suitable for the four players' attack) with the following designations and exceptions:

1. Offenses and defenses may be performed by individual players or by allying more than one player (country) against others, from the very begining of the game or during playing. Strategic and diplomatic wits must be exerted to achieve the final victory, the last surviving player who defeats the other three is the final winner. Some examples are as follows:

Notations used:

| | |
|---|---|
| O | A country represented by each individual player |
| ϕ | The country is extinguished |
| ⟶ | Direction of attack |
| – – – – | Allying line, countries united from the beginning |
| ——— | Allying lines, countries united during the process of playing |

| case | illustration | remarks |
|---|---|---|

-continued

1. Four players each plays individually

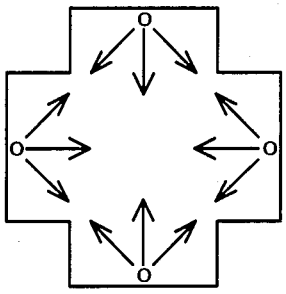

2. Three against one

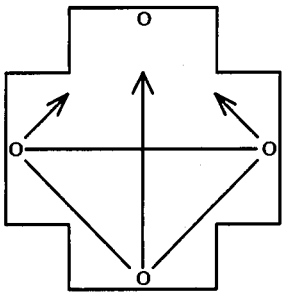

3. Two against two

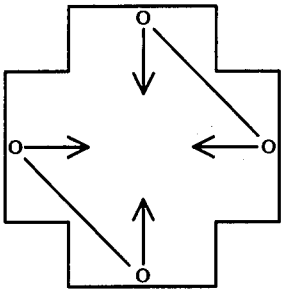

4. Two against two, one country being extinguished first, results in a stronger one against two weaker ones.

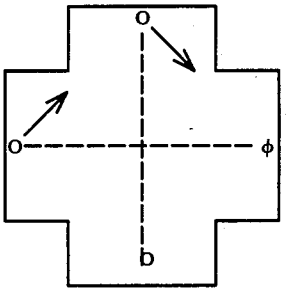

During the game, each player may use diplomatic means to unite allying countries. Yet when the situation changes during the game, if the allying seems of no more benefit or even unfavorable, one country may declare to discontinue the allying with any other country.

2. The Q, B, and Kt are called "Power Pieces" while the "R" is called the "defense piece".
3. Under the new rules provided by the present invention, any piece is not capable of entering the combat bases 12 unless it is in the time of "world war" which shall be related later.
4. The way the power piece enters the combat base is during offensive maneuvers. The power piece of one country may capture any power piece of the oppenent and convert it into his own color and place it in any combat base as desired.
5. Any defense piece being attacked outside the combat base is immediately killed and extinguished.
6. Any defense piece is allowed to enter or leave the combat base freely under the rules and a power piece may launch an attack therefrom, while the defence piece R is not allowed to attack directly from the base. The defense piece R must first move out from the base and stop at a certain position and then launch an attack on the second move.
7. Any piece staying in the base is protected from being attacked by any other pieces except from being attacked by the pawn. When a pawn attacks a base, both the attacker and the attacked become extinguished.
8. A pawn is allowed to move only one square forward at a time in any domain or field, except on the first move when it is allowed to move either one or two squares in the forward direction in the domain.
9. Once the K is checkmated, that country is extinguished and all the rest of the pieces belonging to him are converted at site into the victor's color.
10 When the combat base is not occupied, it does not prevent any power and defence piece from passing. Any piece may get through in one move without being hampered.
11. When the combat bases are fully occupied, the rules of the present invention cease to prevail, and the game goes on according to the conventional rules. By that time, it is considered that the "world war" has broken out. Any piece that is attacked is just killed and distinguished from the board, except that when a king is killed (checkmated), remaining subbordinates of the king are converted at site to the attacker's colors. The "world war" starts from the time of full occupying of the combat bases and lasts to the end of the game.

Figure 3:
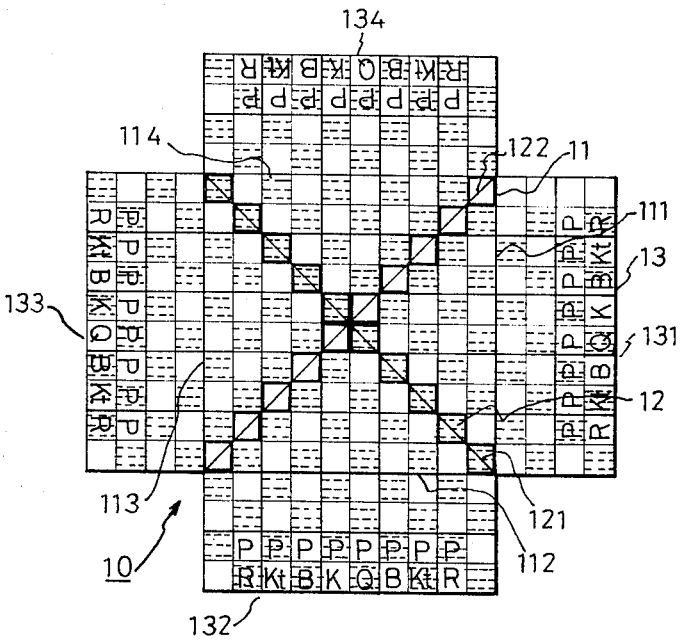
FIG. 3 depicts a plan view of another embodiment of the chess board showing also the initial position of the pieces.

FIG. 3 depicts another embodiment of the chess board, wherein the central field area is 10 × 10 squares instead of 8 × 8 squares, and each domain 13 becomes end 10 × 4 squares. In the initial positioning of the pieces, each end square of the first two row of each side is left blank and unoccupied. The combat bases disposed diagonally within the central field hence are 20 squares instead of 16 .

The above embodiment is given only for illustration purposes and not by way of limitation, and modification will become evident to those skilled in the art which will fall within the scope of attached claims.

I claim:

1. Chess board and pieces provided for playing by four persons comprising and characterized by:

a chess board having a "central field" of 8 × 8 squares, with 16 diagonally disposed squares in the central field designated as "combat bases," extending from each side of the central field an 8 × 4 square "domain" for each player, the squares being colored alternately light and dark, sixty-four chess pieces for the four players representing four countries, each having 16 pieces comprising a king (K), a queen (Q), two bishops (B), two knights (Kt), two rooks (R) and eight pawns (P) with their initial position in the domain as in the conventional chess game, each piece being of a cube shape having four out of its six faces painted with a different color for identification of each country, a symbol representing the said piece being marked on each of the color painted faces of the cube.

2. Chess board and pieces provided for playing by four persons comprising and characterized by:

a chess board having a "central field" of 10 × 10 squares, with 20 diagonally disposed squares in the central field designated as "combat bases," extending from each side of the central field a 10 × 4 square "domain" for each player, the squares being colored alternately light and dark, sixty-four chess pieces for the four players representing four countries, each having 16 pieces comprising a king (K), a queen (Q), two bishops (B), two knights (Kt), two rooks (R) and eight pawns (P) with their initial position in the domain as in the conventional chess game, each piece being of a cube shape having four out of its six faces painted with a different color for identification of each country, a symbol representing the said piece being marked on each of the color painted faces of the cube.

* * * * *